US005886507A

United States Patent [19]

Janik

[11] Patent Number: 5,886,507

[45] Date of Patent: Mar. 23, 1999

[54] CONTROLLED FERRORESONANT TRANSFORMER

[75] Inventor: Raymond G. Janik, Bloomingdale, Ill.

[73] Assignee: Shape Electronics, Inc., Addison, Ill.

[21] Appl. No.: 915,051

[22] Filed: Aug. 20, 1997

[51] Int. Cl.[6] ..... G05F 1/13; H01F 27/28

[52] U.S. Cl. ..... 323/248; 336/184

[58] Field of Search ..... 323/248, 355, 323/309; 363/75; 336/184, 212, 215

[56] References Cited

U.S. PATENT DOCUMENTS

| | | | |
|---|---|---|---|
| 3,573,606 | 4/1971 | Hart et al. . | |
| 3,739,257 | 6/1973 | Hunter . | |
| 3,781,630 | 12/1973 | Ballman . | |
| 3,965,408 | 6/1976 | Higuchi et al. | 363/75 |
| 4,142,141 | 2/1979 | Hase . | |
| 4,156,175 | 5/1979 | Nissan . | |
| 4,313,060 | 1/1982 | Fickenscher et al. | 307/23 |
| 4,439,722 | 3/1984 | Budnik . | |
| 4,465,966 | 8/1984 | Long et al. . | |
| 4,806,834 | 2/1989 | Koenig . | |
| 5,117,176 | 5/1992 | Bobry . | |
| 5,539,300 | 7/1996 | Mathieu . | |
| 5,668,707 | 9/1997 | Barrett | 363/44 |
| 5,737,203 | 4/1998 | Barrett | 363/75 |

*Primary Examiner*—Adolf Deneke Berhane
*Attorney, Agent, or Firm*—McCormick, Paulding & Huber

[57] ABSTRACT

A ferroresonant transformer includes a three-legged magnetic core. The core includes a center leg, and first and second flanking legs. Each of the center and flanking legs have respective first and second longitudinal ends. The first flanking leg is positioned at an opposite side of the center leg relative to the second flanking leg. A first end-connecting portion magnetically couples the first ends of the center and flanking legs, and a second end-connecting portion magnetically couples the second ends of the center and flanking legs. The center leg defines a substantially non-magnetic space, such as an air gap, along a magnetic flux path extending along the center leg from the first end-connecting portion to the second end-connecting portion in order to reduce the total harmonic distortion of the ferroresonant transformer.

13 Claims, 5 Drawing Sheets

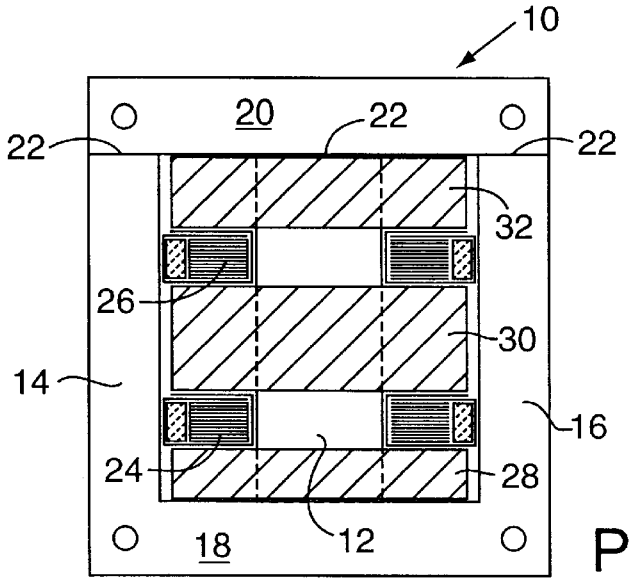
FIG. 1
PRIOR ART
FIG. 2
PRIOR ART
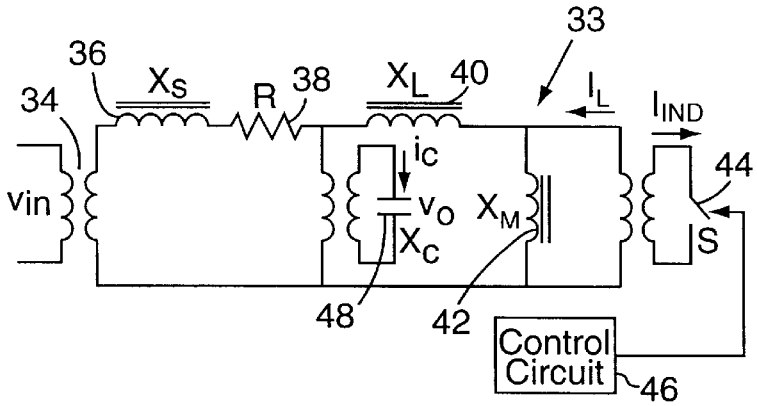
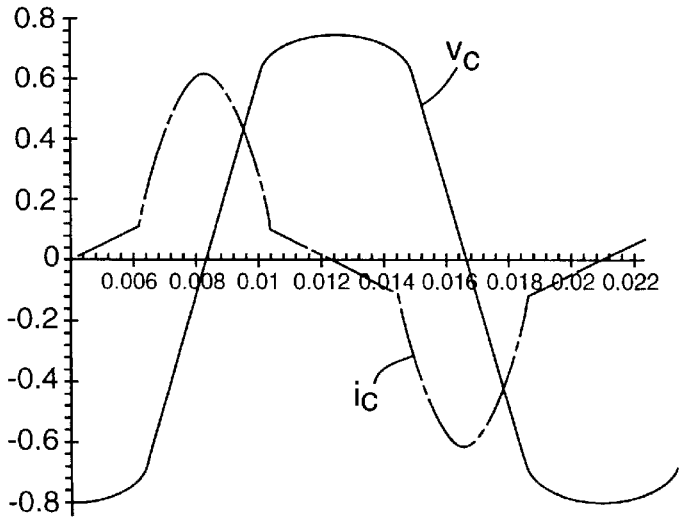
FIG. 3
PRIOR ART

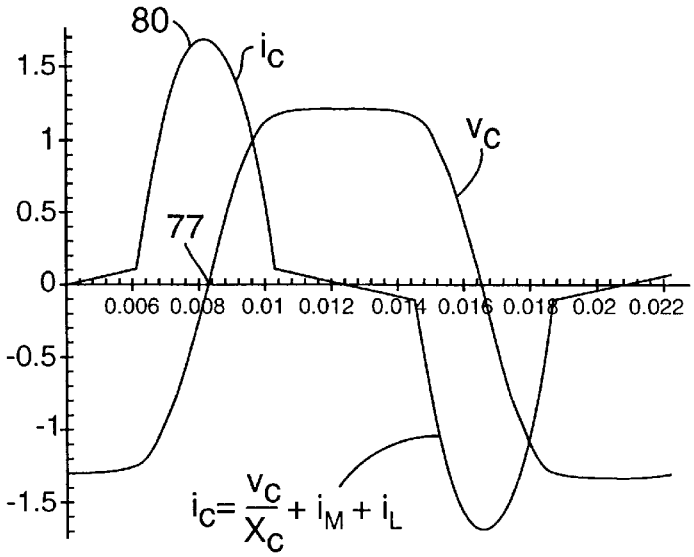
FIG. 7
PRIOR ART
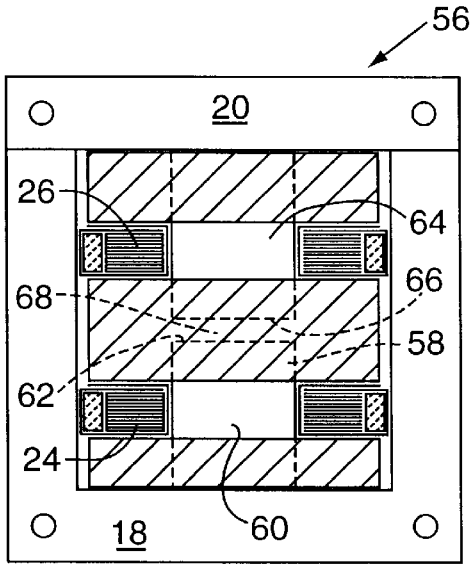
FIG. 8
FIG. 9
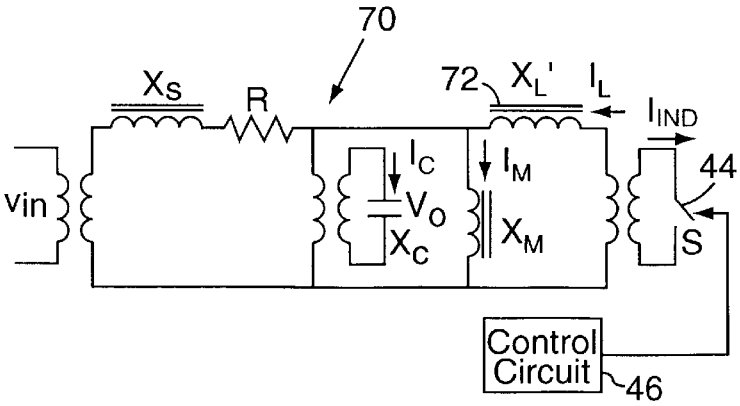

CONTROLLED FERRORESONANT TRANSFORMER

CROSS REFERENCE TO RELATED PATENT

This application incorporates by reference the disclosure in U.S. Pat. No. 3,573,606.

BACKGROUND OF THE INVENTION

The present invention relates to ferroresonant transformers, and deals more particularly with closed-loop ferroresonant transformers having controlled output voltage harmonics.

(1) Field of the Invention

Ferroresonant transformers are often used for voltage regulation. The voltage regulation is accomplished by precisely controlling the magnetic saturation of the transformer core. The control of magnetic saturation is typically accomplished by employing a control inductor winding in addition to the input/output windings. The control winding carries a direct current in order to generate a desired amount of magnetic flux which is added to the magnetic flux generated by the input winding to form a resultant magnetic flux. The control winding can thus "fine tune" the amount of the resultant magnetic flux, and consequently adjust the amount of input current necessary to magnetically saturate the core. Ensuring operation of the transformer while in magnetic saturation ensures that the output voltage is regulated.

(2) Description of Prior Art

Ferroresonant transformers have been developed to electronically simulate core saturation. In other words, voltage regulation is achieved without the need for actually magnetically saturating the core. For example, U.S. Pat. No. 3,573,606, which is hereby incorporated by reference, shows a nonsaturating switching type ferroresonant regulator. The function of the saturating core is supplied by an inductance and a switch.

A common drawback with prior ferroresonant transformers is that the output voltage of such transformers typically exhibit high total harmonic distortion (THD) sine waves. Expensive harmonic traps normally must be employed to bring the THD down to an acceptable level.

It is therefore an object of the present invention to provide a closed-loop ferroresonant transformer which adjusts the various electromagnetic parameters in order to control the output voltage waveform from a low THD sinewave to a high rise-time quasi square wave which improves performance and does not require the use of expensive filter chokes.

SUMMARY OF INVENTION

The present invention resides in a ferroresonant transformer comprising a three-legged magnetic core. The core includes a center leg, and first and second flanking legs. Each of the center and flanking legs have respective first and second longitudinal ends. The first flanking leg is positioned at an opposite side of the center leg relative to. the second flanking leg. A first end-connecting portion magnetically couples the first ends of the center and flanking legs, and a second end-connecting portion magnetically couples the second ends of the center and flanking legs. The center leg defines a substantially non-magnetic space, such as an air gap, along a path extending from the first end-connecting portion to the second end-connecting portion via the center leg. An input coil is wound around the center leg, and an output coil is wound around and longitudinally spaced on the center leg relative to the input coil A control coil is also wound around and longitudinally spaced on the center leg relative to the input and output coils for adjusting the flux density through the magnetic core.

The present invention also resides in a three-legged magnetic core. The core includes a center leg, and first and second flanking legs. Each of the center and flanking legs have respective first and second longitudinal ends. The first flanking leg is positioned at an opposite side of the center leg relative to the second flanking leg. A first end-connecting portion magnetically couples the first ends of the center and flanking legs, and a second end-connecting portion magnetically couples the second ends of the center and flanking legs. The center leg defines a substantially non-magnetic space, such as an air gap, along a path extending from the first end-connecting portion to the second end-connecting portion via the center leg.

One advantage of the present invention is that the total harmonic distortion of the output signal of the ferroresonant transformer can be easily controlled without sacrificing performance or using expensive filter chokes.

Other objects and advantages of the present invention will become apparent in view of the following detailed description and accompanying drawings.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein:

FIG. 1 schematically illustrates a prior art ferroresonant transformer.

FIG. 2 is a schematic circuit associated with the transformer of FIG. 1.

FIG. 3 is a graph illustrating waveforms of signals generated by the transformer of FIG. 1.

FIG. 7 is a graph illustrating waveforms of signals associated with a fast rise time application of ferroresonant transformers.

FIG. 8 schematically illustrates a first embodiment of a ferroresonant transformer in accordance with the present invention.

FIG. 9 is a schematic circuit associated with the transformer of FIG. 8.

BACKGROUND DISCUSSION OF FERRORESONANT TECHNOLOGY

Figure 4:
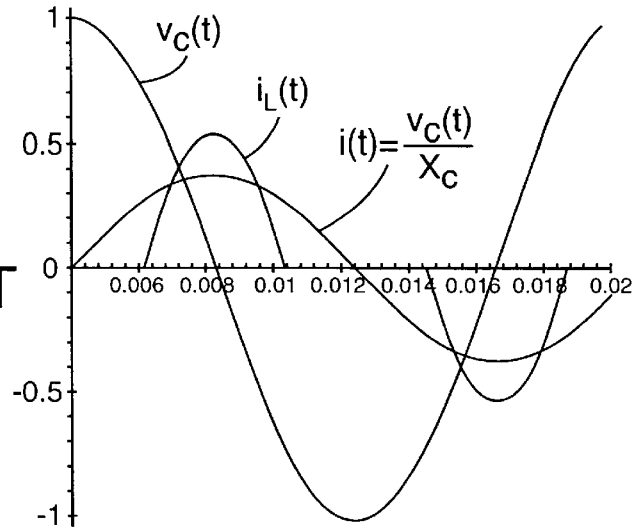
FIG. 4 PRIOR ART
FIG. 4 is a graph further illustrating waveforms of signals generated by the transformer of FIG. 1.
Figure 5:
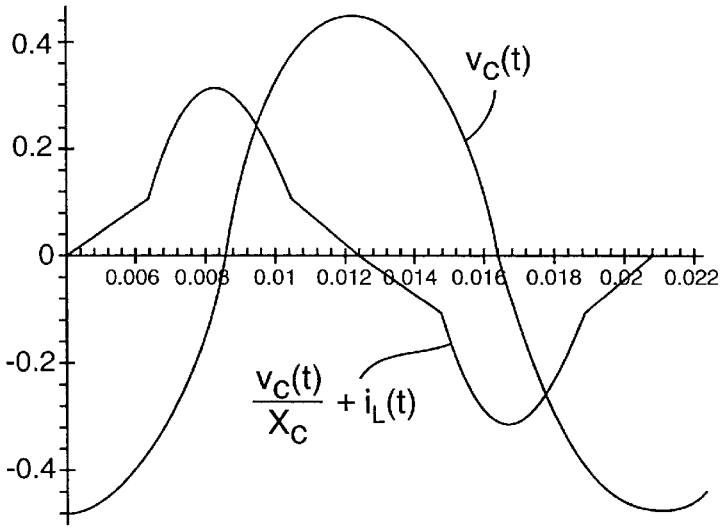
FIG. 5 PRIOR ART
FIG. 5 is a graph illustrating waveforms of signals having reduced THD generated by the transformer of FIG. 6.

FIGS. 1–7 refer to examples of prior ferroresonant transformers in order to better understand the improvements and distinguishing features of the present invention set forth in FIGS. 8–13.

One prior art ferroresonant transformer, as shown in FIG. 1, is generally referenced by the number 10. The transformer 10 typically comprises a magnetic core having three legs: a center leg 12, and first and second flanking legs 14 and 16, respectively. The legs 12, 14 and 16 have respective first longitudinal ends that are magnetically coupled to one another via a first end-connecting portion 18 which, as shown in FIG. 1, is formed integrally with the legs. As can be seen in FIG. 1, the legs and first end-connecting portion cooperate to form an E shaped member. A separately formed second end-connecting portion 20, taking the form of an I shaped member, abuts against respective second longitudinal ends 22 of the legs 12, 14 and 16. The E shaped member and I shaped member therefore cooperate to form the magnetic core of the transformer 10. The transformer 10 further includes a first or series inductance shunt 24 and a second or control inductance shunt 26 each extending outwardly from the center leg 12. The transformer also includes an input coil 28, an output coil 30 and a control inductance coil 32 that are typically employed with ferroresonant transformers. As can be seen in FIG. 1, each of the coils extends outwardly from and circumaxially about the center leg 12.

FIG. 2 schematically illustrates an equivalent electrical circuit 33 of the transformer 10. The equivalent circuit 33 includes an AC input voltage $v_{in}$ at 34, an inductance 36 having reactance $X_s$ representing the leakage inductance of the series inductance shunt 24 of FIG. 1, a resistance R at 38 representing the equivalent resistance of all the windings in FIG. 1, an inductance 40 having reactance $X_L$ representing the control inductance of the control inductance shunt 26, an inductance 42 having reactance $X_M$ representing the magnetizing inductance, a control circuit switch S at 44 that is opened and closed by a control circuit 46. The magnetizing inductance $X_M$ is usually ignored when the control circuit switch S is opened because $X_M >> X_L$. An output capacitor at 48 provides the output voltage $v_o$ across its terminals.

The output voltage $v_o$ of a controlled ferroresonant transformer, such as the transformer described in FIGS. 1–4, is the voltage $v_c$ across the output capacitor 48 (shown in FIG. 2), and is defined by the following equations set forth below. All lower case symbols are instantaneous values (i.e., v(t), i(t), etc.), and all upper case symbols are root-mean-square (RMS) values (i.e., V, I, etc.).

$$v_0(t) = v_c(t) = \frac{1}{C}\int_{t0}^{t} i_c(t)dt \tag{1}$$

$$I_c = \frac{V_c}{X_c} + I_L \tag{2}$$

$$I_L = \frac{V_0}{X_M + X_L}\text{, when } S \text{ is open} \tag{3}$$

$$I_L = \frac{V_0}{X_L}\text{, when } S \text{ is closed} \tag{4}$$

$$i_L(t) = \frac{1}{L}\int_{t0}^{t} v_0(t)dt \tag{5}$$

where: Vo or $v_o(t)$ is the output voltage, $V_c$ or $v_c(t)$ is the voltage across the output capacitor, $I_c$ or $i_c(t)$ is the current charging/discharging the output capacitor as defined by equation (1), $I_L$ or $i_L(t)$ is the control inductor current, C is the capacitance of the output capacitor, $I_{ind}$ is the current of the control inductor coil and switch, $X_M$ is the magnetizing reactance, L is the control inductance, $t_0$ is the time the switch S turns on, $t_1$ is the time the switch S turns off, t is any point in time between $t_0$ and $t_1$, the on/off time being determined by the control circuit 46. FIGS. 3 and 4 are graphs showing the relationship of various signals described and defined in the preceding equations.

With reference to FIG. 2, the leakage inductance 36 cooperates with the output capacitor 48 to generate an electromagnetic resonance such that at low line-full load, the output voltage $V_o$ will be qualified. Closing the control circuit switch 44 will place the inductance 40 having reactance $X_L$ in parallel with the output capacitor 48 having reactance $X_c$, which will reduce the equivalent capacitive reactance: $X_c' = X_c | X_L$. The new reactance $X_c'(<X_c)$ will reduce gain such that at high line-no load, the output voltage $V_o$ will remain qualified. The control circuit 46 will sense the output voltage $V_o$ and control the triggering of the control circuit switch 44 so that the output voltage $v_o$ is always regulated anywhere between the two extreme cases of low line-full load and high line-no load. For example, if a silicon controlled rectifier (SCR) is part of the control circuit 46, controlling the SCR trigger phase angle can be employed to regulate the output voltage $v_o$. Yet, the waveform for $i_c$ illustrated in FIG. 3 and defined in equation (2) show that discontinuity in $i_L$ also causes $i_c$ to be discontinuous. Since the instantaneous value of $i_c$ is proportional to the slope of the output capacitor voltage $v_c$, as defined in equation (1), then $v_c$ will reflect discontinuity in $i_c$ in the form of high total harmonic distortion (see FIG. 3). It follows from equations (2), (3) and (4) that discontinuity in $i_c$ and total harmonic distortion is reduced if $X_M$ is reduced relative to $X_L$ which will reduce discontinuity in $i_C(t)$ in the neighborhood of $t_0$ and $t_1$ (see FIG. 5). The reduction in total harmonic distortion is one of the advantages of the present invention which is discussed immediately below.

If $X_M$ is to reduce in value in order to reduce total harmonic distortion (see FIG. 5), a proportional reduction in$X_c$ is required to maintain the same equivalent reactance of the parallel combination of $X_M$ and $X_c$. The current $i_M$ will increase in magnitude if the magnetizing reactance $X_M$ is reduced.

Figure 6:
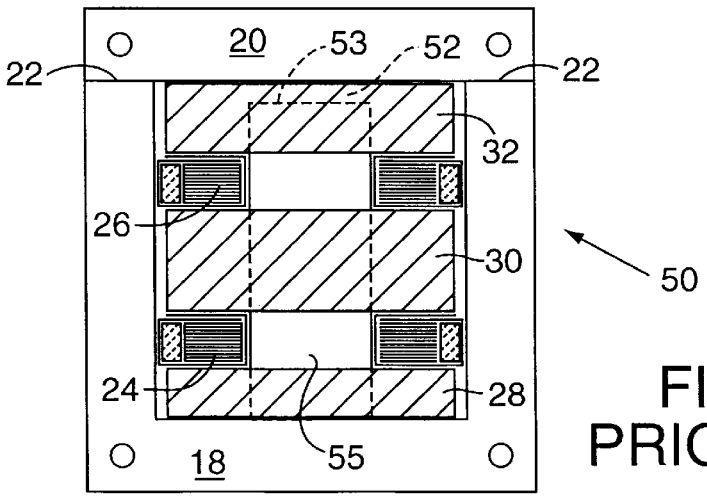
FIG. 6 PRIOR ART
FIG. 6 schematically illustrates another prior art ferroresonant transformer.

A ferroresonant transformer 50, as shown in FIG. 6, exhibits a reduced magnetizing reactance $X_M$ caused by a substantially non-magnetic space at 52 which is defined by the space between the E and I shaped members. More specifically, a second longitudinal or free end 53 of a center leg 55 is spaced from an adjacent portion of the second end-connecting portion 20 so as to form the non-magnetic space 52 therebetween. The ferroresonant transformer of FIG. 6, however, tends to exhibit higher acoustic noise and lower efficiency relative to the transformer of FIG. 1. The equivalent electrical circuit 33 of FIG. 2 applies also for the ferroresonant transformer 50 with the exception that magnitude of $X_M$ is reduced when the control circuit switch S is opened.

When the control circuit switch 44 of FIG. 2 is open, the current through the output capacitor 48 is limited by $X_M + X_L$, where $X_L << X_M$. When the control circuit switch 44 is closed, the current through the output capacitor 48 is only limited by $X_L$. The value of $X_L$ is selected so that at high line-no load, $i_L$ is high enough to maintain a nominal output voltage $v_o$.

With reference to FIG. 7, some ferroresonant transformer applications are best suited by a square wave voltage output. An example is a DC power supply for television cable systems. The slope of the output voltage is defined by $dv(t)/dt = dv_c(t)/dt = i_c/C$. The slope of an output voltage waveform (labelled $v_c$) must be very high (at point 77 of the $v_c$ waveform) near the peak of total capacitor current waveform (point 80 of the $i_c$ waveform), and very low near the zero crossing of the $i_c$ waveform. But $I_c=(V_c/X_c)+i_L$, where $i_L$ is defined by equations (3) and (4).

The control inductor current $I_{IND}$ (see FIG. 2) is normally kept to a minimum to increase efficiency and reduce cost. Increasing the control inductor current beyond its minimum value will result in a lower duty cycle, dictated by the control circuit, and the output voltage required. A low duty cycle, high amplitude inductor current will result in a high crest factor for the total capacitor current and contribute to a high voltage rise time. The crest factor is the ratio of the peak value to the root-mean-square (RMS) value of the waveform. As for the portion of the voltage waveform near the peak, the slope has to be a minimum which requires the capacitor current to have a very low amplitude which is usually the case since the control inductor switch is off, and the only inductive current through the capacitor is $V_C/(X_M+X_L)$. To further reduce the capacitor current near the zero crossing, the magnetizing reactance $X_M$ is increased by interleaving the laminations when the transformer is assembled. A disadvantage of this method is that a high inductor current $I_{IND}$ (see FIG. 2) will reduce the efficiency of the system because of increased $I^2R$ losses in the inductor coil and will require a more expensive AC switch to handle the higher current.

DESCRIPTION OF FIRST PREFERRED EMBODIMENT

FIGS. 8 and 9 refer to a first embodiment of the present invention. As can be seen in FIG. 8, a ferroresonant transformer 56 has a center leg 58 having first and second leg ends 59 and 61 respectively located adjacent to the first and second end-connecting portions 18 and 20. The center leg 58 includes two physically separate longitudinal portions. A first longitudinal portion 60 of the center leg 58 extends from the first leg end 59 adjacent to the first end-connecting portion 18 and terminates at a first free end 62 about midway between the first and second leg ends 59 and 61 adjacent to the first and second end-connecting portions 18 and 20, respectively. As can be seen in FIG. 8, the first free end 62 of the first longitudinal portion 60 is slightly closer to the first end-connecting portion 18 than to the second end-connecting portion 20. A second longitudinal portion 64 of the center leg 58 extends from the second leg end 61 adjacent to the second end-connecting portion 20 and terminates at a second free end 66 about midway between the first and second leg ends 59 and 61 adjacent to the first and second end-connecting portions 18 and 20, respectively. As can be seen in FIG. 8, the second free end 66 of the second longitudinal portion 64 is slightly closer to the second end-connecting portion 20 than to the first end-connecting portion 18.

The first free end 62 of the first longitudinal portion 60 of the center leg 58, and the second free end 66 of the second longitudinal portion 64 of the center leg 58 define a substantially non-magnetic space 68 therebetween. As can be seen in FIG. 8, the air gap 68 is located longitudinally midway along the center leg 58 of the E shaped member between the first and second leg ends 59 and 61, and the first and second magnetic shunts 24, 26.

FIG. 9 schematically illustrates an equivalent electrical circuit 70 of the ferroresonant transformer 56 of FIG. 8. Like parts of preceding figures are labeled with like reference numbers and symbols. As shown in FIG. 9, an inductance 72 having reactance $X_L'$ represents the control inductance which is positioned differently in the circuit 70 as compared to the inductance 40 having reactance $X_L$ of the circuit 33 of FIG. 2. Referring to the circuit 70 of FIG. 9, when the control circuit switch 44 is opened by the control circuit 46, the inductive current through the capacitor is limited by $X_M$. When the switch 44 closes, the current is limited by the parallel combination of $X_M$ and $X_L'$ such that $X_M|X_L'=X_L$, whereby the reactance $X_L'$ of the circuit 70 of FIG. 9 will have a higher value relative to the reactance $X_L$ of the circuit 33 of FIG. 2. As a result, moving the air gap to the middle of the center leg (as shown in FIG. 8) will result in reducing the inductor current $i_L$ as well as reducing the size of the magnet wire necessary to handle the current $i_{IND}$. Consequently, the size of the transformer can be reduced, and power efficiency can be improved over prior ferroresonant transformers.

DESCRIPTION OF SECOND PREFERRED EMBODIMENT

Figure 11:
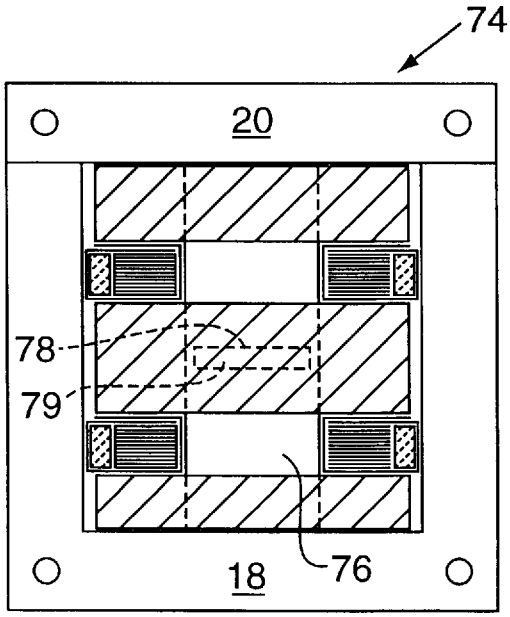
FIG. 11 schematically illustrates a second embodiment of a ferroresonant transformer in accordance with the present invention.

FIG. 11 refers to a third embodiment of the present invention where like elements are labeled by like reference numbers. A ferroresonant transformer 74 includes a center leg 76 having first and second leg ends 81 and 83 respectively located adjacent to the first and second end-connecting portions 18 and 20. The center leg 76 define a slot 78 provided about longitudinally midway along the center leg 76 between the first and second leg ends 81, 83 and first and second end-connecting portions 18 and 20, respectively. The slot 78 extends through the center leg in a direction transverse to the plane of the figure so as to form a bridged substantially non-magnetic space 78 along the center leg 76. In other words, a non-magnetic space can be introduced in the center leg without dividing the center leg into two physically separate portions. The slot may be formed by a punching process or the like.

Non-magnetic spaces, such as air gaps, are usually associated with acoustic noise because it is very difficult to keep transformer parts close to the non-magnetic space from vibrating. With the bridged non-magnetic space 78 provided about longitudinally midway along the center leg 76 between the first and second leg ends 81 and 83, it is possible to punch a slot in the middle of the center leg, as shown in FIG. 11, and interleave laminations of the center leg 76. The slot defined by each lamination will align to produce the same effect as the non-magnetic space 68 illustrated in FIG. 8. The center leg 76 has greater structural strength in the vicinity of the bridged non-magnetic space 78, as compared to the center leg 58 in the vicinity of the non-magnetic space 68 of FIG. 8. As a consequence, the ferroresonant transformer 74 of FIG. 11 will generate less vibration and related noise relative to the ferroresonant transformer 56 of FIG. 8.

Figure 10:
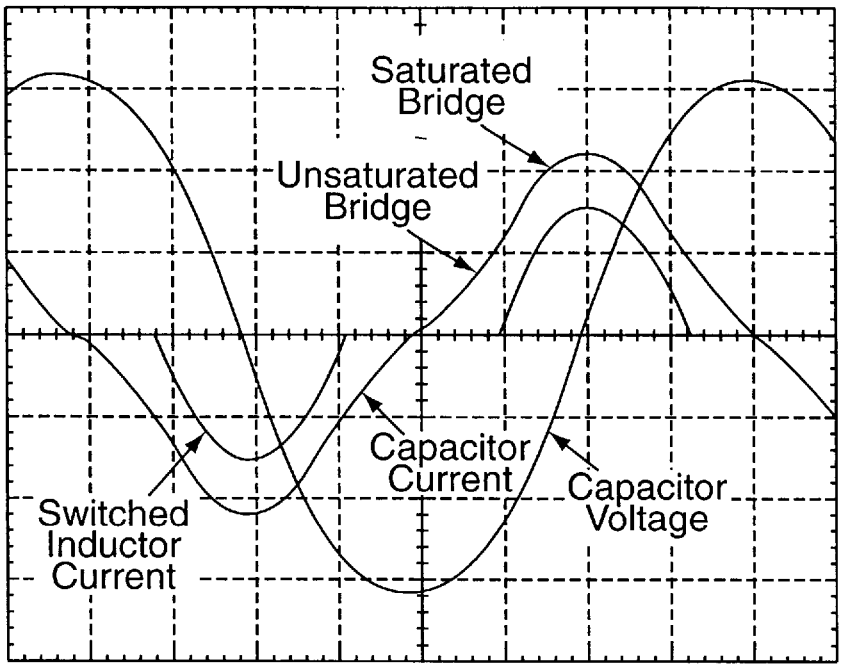
FIG. 10 is a graph illustrating various features of the transformer of FIG. 11.

The width of a bridge 79 (i.e., narrow portion of the center leg 76 in the vicinity of the non-magnetic space 78) is limited by the effect its magnetic saturation will have on the voltage output waveform. The bridge 79 will saturate at a certain volt-second and the peak total capacitor current will coincide with that of the switched inductor current, and therefore will have the same effect in increasing discontinuity in the total capacitor current. (See the graph of FIG. 10 illustrating the relationships among $v_c$, $i_L$ and $i_c$). Keeping the width of the bridge 79 to a minimum will reduce the effect of saturation on the output voltage level. A practical bridge width is the minimum required for proper handling of the laminations.

DESCRIPTION OF THIRD PREFERRED EMBODIMENT

Figure 12:
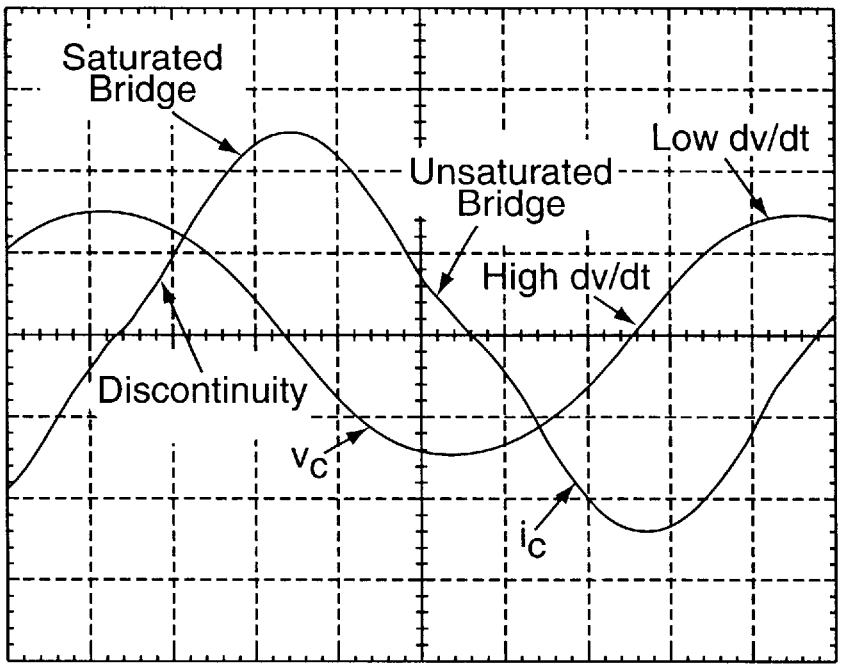
FIG. 12 is a graph illustrating various features of the ferroresonant transformer of FIG. 13.
Figure 13:
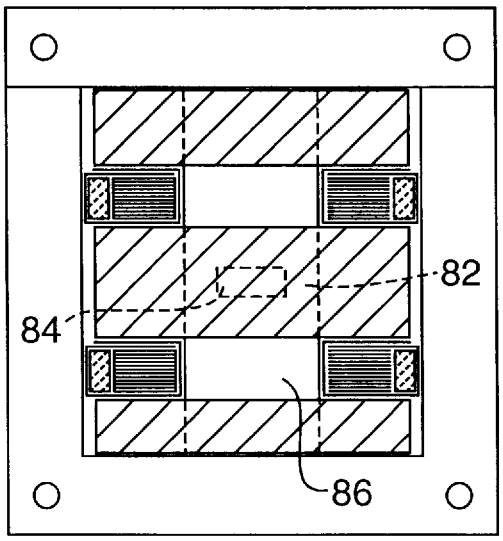
FIG. 13 schematically illustrates a third embodiment of a ferroresonant transformer in accordance with the present invention.

Turning now to FIGS. 12 and 13, some applications of a ferroresonant transformer require a fast rise time voltage waveform. A currently used method is to increase the control inductor current $I_L$. This increased current will require a thicker gauge magnet wire for the control inductor coil and a larger current capacity switch. The increased current will also reduce the efficiency due to increased $I_L^2R$ losses.

Another way to achieve the same effect without increasing the inductor current is to slightly saturate the core. By increasing the bridge width of the core (see FIG. 13 illustrating a wide bridge 82 adjacent a gap 84 defined in a center leg 86) the bridge portion of the center leg will saturate near the voltage zero crossing of the waveform $v_c$ which will increase the magnetizing current illustrated by waveform $i_c$ in FIG. 12). The peak of the saturation magnetizing current will coincide with the switched inductor current and will have the same effect in increasing the slope of the voltage waveform. As the voltage waveform reverses, the volt-second of the core will reduce which will bring the bridge portion of the center leg out of saturation and the magnetizing current will reduce to its linear low value (see FIG. 12). The core losses will increase very slightly because saturation is limited to the bridge, a very small portion of the core. Nevertheless, the reduced control inductor current is significant and will increase efficiency. These principles apply not only for EI laminations, but also for any type of magnetic steel.

While the present invention has been described in several preferred embodiments, it will be understood that numerous modifications and substitutions can be made without departing from the spirit or scope of the invention. Accordingly, the present invention has been described in several preferred embodiments by way of illustration, rather than limitation, and the scope of this patent disclosure shall not be determined primarily from the scope of the appended claims.

What is claimed is:

1. A ferroresonant transformer comprising:

a three-legged magnetic core, the core including a center leg having first and second leg ends and first and second flanking legs, each of the flanking legs having respective first and second longitudinal ends, the first flanking leg being positioned at an opposite side of the center leg relative to the second flanking leg, a first end-connecting portion magnetically coupling the first ends of the center and flanking legs, and a second end-connecting portion magnetically coupling the second ends of the center and flanking legs, the center leg defining a substantially non-magnetic space between the first and second leg ends of the center leg an input coil wound around the center leg;

an output coil wound around and longitudinally spaced on the center leg relative to the input coil; and a control coil wound around and longitudinally spaced on the center leg relative to the input and output coils for adjusting the flux density through the magnetic core.

2. A ferroresonant transformer as defined in claim 1, wherein the non-magnetic space defined by the center leg extends through the center leg in a direction substantially transverse to the axial direction of the center leg.

3. A ferroresonant transformer as defined in claim 2, wherein the non-magnetic space defined by the center leg is positioned longitudinally along the center leg generally midway between the first and second end-connecting portions.

4. A ferroresonant transformer as defined in claim 1, wherein the center leg includes a first longitudinal portion extending from the first leg end and terminating at a first free end at a first location between the first and second leg ends, and a second longitudinal portion extending from the second leg end and terminating at a second free end at a second location between the first and second leg ends the first and second free ends being longitudinally spaced from each other so as to define the non-magnetic space therebetween.

5. A ferroresonant transformer as defined in claim 1, wherein the center leg includes a first longitudinal portion extending from the first leg end and terminating at a first free end at a first location about midway between the first and second leg ends, and a second longitudinal portion extending from the second leg end and terminating at a second free end at a second location about midway between the first and second leg ends, the first and second end free ends being longitudinally spaced from each other so as to define the non-magnetic space therebetween.

6. A ferroresonant transformer as defined in claim 1, wherein the first end-connecting portion is integrally formed as one piece with the center and the flanking legs to form an E shaped member, and the second end-connecting portion forms an I shaped member that is separate from the E shaped member.

7. A ferroresonant transformer as defined in claim 1, further including a first magnetic shunt extending from the center leg at a longitudinal position between the input coil and the output coil, and a second magnetic shunt extending from the center leg at a longitudinal position between the output coil and the control coil.

8. A magnetic core comprising:

a center leg having first and second leg ends;

first and second flanking legs each having respective first and second longitudinal ends, the first flanking leg being positioned at an opposite side of the center leg relative to the second flanking leg;

a first end-connecting portion magnetically coupling the first ends of the center and flanking legs; and a second end-connecting portion for magnetically coupling the second ends of the center and flanking legs, the center leg defining a substantially non-magnetic space between the first and second leg ends of the center leg.

9. A magnetic core as defined in claim 8, wherein the non-magnetic space defined by the center leg extends through the center leg in a direction substantially transverse to the axial direction of the center leg.

10. A magnetic core as defined in claim 9, wherein the non-magnetic space defined by the center leg is positioned longitudinally along the center leg generally midway between the first and second end-connecting portions.

11. A magnetic core as defined in claim 8, wherein the center leg includes a first longitudinal portion extending from the first leg end and terminating at a first free end at a first location between the first and second leg ends, and a second longitudinal portion extending from the second leg end and terminating at a second free end at a second location between the first and second leg ends the first and second free ends being longitudinally spaced from each other so as to define the non-magnetic space therebetween.

12. A magnetic core as defined in claim 8, wherein the center leg includes a first longitudinal portion extending from the first leg end and terminating at a first free end at a first location about midway between the first and second leg ends, and a second longitudinal portion extending from the second leg end and terminating at a second free end at a second location about midway between the first and second leg ends, the first and second end free ends being longitudinally spaced from each other so as to define the non-magnetic space therebetween.

13. A magnetic core as defined in claim 8, wherein the first end-connecting portion is integrally formed as one piece with the center and the flanking legs to form an E shaped member, and the second end-connecting portion forms an I shaped member that is separate from the E shaped member.

* * * * *